United States Patent [19]

Vandeweghe et al.

[11] Patent Number: 5,044,408

[45] Date of Patent: Sep. 3, 1991

[54] DEVICE FOR MOVING THE BACK REST IN WEAVING MACHINES

[75] Inventors: Michel Vandeweghe, Wijtschate-Heuvelland; Bart Levever, Ieper; Stefaan Vandersyppe, Wervik, all of Belgium

[73] Assignee: Picanol N.V., naamloze vennootschap, Belgium

[21] Appl. No.: 552,560

[22] Filed: Jul. 16, 1990

[30] Foreign Application Priority Data

Jul. 17, 1989 [BE] Belgium ..... 8900779

[51] Int. Cl.[5] ..... D03D 49/14; D03D 49/22

[52] U.S. Cl. ..... 139/115

[58] Field of Search ..... 139/114, 115, 110

[56] References Cited

U.S. PATENT DOCUMENTS 3,072,153 1/1963 Law ..... 139/115 X
3,552,447 1/1971 Cosetta .
3,567,354 3/1971 Franssen et al. .
4,256,147 3/1981 Deborde ..... 139/115

*Primary Examiner*—Andrew M. Falik
*Attorney, Agent, or Firm*—Bacon & Thomas

[57] ABSTRACT

A device for moving a back rest in weaving machines includes two movable supporting mechanisms between which the back rest is mounted, an eccentric for moving the supporting mechanisms and whose eccentricity can be modified, and a driving wheel for driving the eccentric. A mechanism provided between the driving wheel and the eccentric permits a continuous setting of the phase of the eccentric in relation to the driving wheel. The mechanism includes a seating formed in the driving wheel, an element which fits in the seating and which can be axially turned in relation to the driving wheel to which the eccentric is coupled, and a clamp for clamping the element at any required angular position in the seating.

13 Claims, 6 Drawing Sheets

DEVICE FOR MOVING THE BACK REST IN WEAVING MACHINES

BACKGROUND OF THE INVENTION

The present invention concerns a device for moving the back rest in weaving machines, in particular according to a periodical movement.

It is known that, in weaving machines, the back rest has to move to and fro in accordance with the harness motion, this in order to obtain that, in spite of the opening and closing of the shed, the warp tension remains practically the same. As known from U.S. Pat. No. 3,567,354, the required periodical movement to this end can be obtained by means of the connecting rods which are connected to the back rest and driven by the sley.

It is also known that said periodical movement of the back rest can be obtained by means of an eccentric, driven by the main shaft of the weaving machine. This known embodiment is usually also provided with adjusting means to set the eccentricity. The setting of the eccentricity may involve a phase shift between the movements made respectively by the harnesses and the back rest. It is obvious that the phase between said movements has to be reset.

In order to obtain that the warp tension remains practically the same in spite of the opening and closing of the shed, the movement of the back rest has to be more or less in phase with the opening and closing of the shed. It is known, however, that, depending on the cloth to be woven, the movement of the harnesses in relation to the movement of the sley or the main shaft of the weaving machine may be changed. In order to obtain, in case of such a change, that said movement of the back rest, which has been obtained by the movement of the main shaft, remains in phase with the opening and closing of the shed, also the phase between the main shaft and the movement of the back rest has to be set.

In the known embodiments, this is done by driving the eccentric by means of a gear wheel clutch, such that, through the release of these clutches and through the mutual turning of the gear wheels, the setting can be executed.

It is clear that this is a time-consuming method which does not allow for continuous setting.

SUMMARY OF THE INVENTION

The present invention concerns a device for moving the back rest in weaving machines which does not have the disadvantages of conventional phase setting devices, in other words, which has as an advantage that the setting of said phase is very simple and is not limited to a number of present values.

To this aim, the invention concerns a device for moving the back rest in weaving machines, in particular according to a periodical movement, consisting of two moveable supporting mechanisms in between which the back rest is mounted; at least one eccentric for moving the supporting mechanisms; a driving wheel to drive the eccentric; and driving means to drive the driving wheel; characterized in that means have been provided in between the driving wheel and the eccentric, allowing for a continuous setting of the phase of the eccentric in relation to the driving wheel, whereby said means consist of a seating connected to the driving wheel and placed in a centric position in relation to that driving wheel; an element which fits in the seating and which can be turned around in relation to said seating, and to which the eccentric is coupled; and clamping means which can clamp the turnable element in any required angle position in the seating.

In preference, the above-mentioned seating and the element which fits in it are conically shaped, whereas the clamping means consist of a bolt-shaped element which fastens the conical element axially in the seating as it is screwed.

BRIEF DESCRIPTION OF THE DRAWINGS

In order to better explain the characteristics of the invention, by way of example only and without being limitative in any way, the following preferred embodiment is described with reference to the accompanying drawings, where.

DETAILED DESCRIPTION OF THE PREFERRED EMBODIMENT

Figure 1:
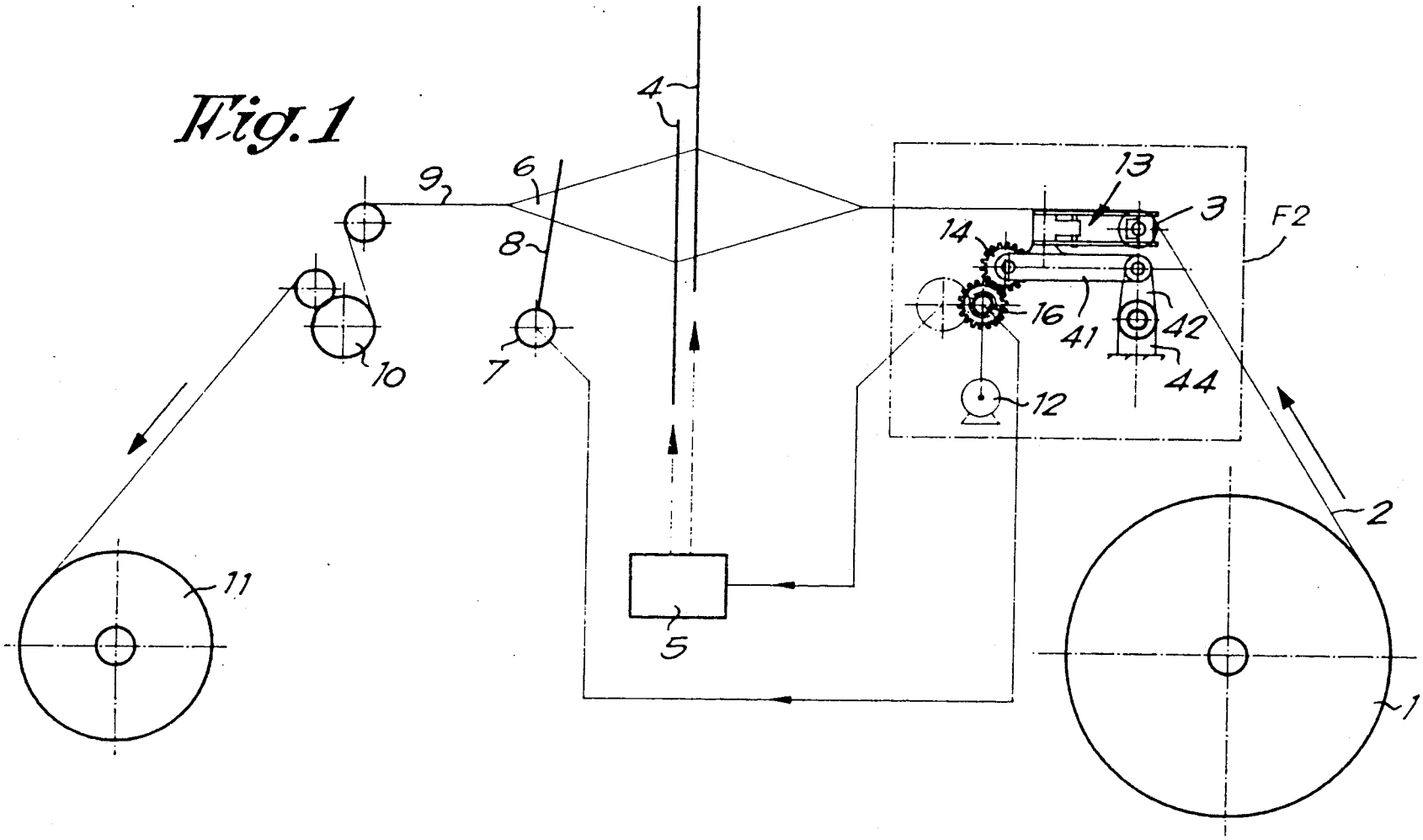
FIG. 1 is a schematic representation of a weaving machine which uses the device according to the invention.

FIG. 1 is a schematic representation of a weaving machine having as main parts the warp beam 1, the warp 2, the back rest 3, the harnesses 4, the harness drive 5, the shed 6, the sley 7 with the reed 8, the formed cloth 9, the sand roller 10, the cloth beam 11 and the main drive motor 12.

Figure 2:
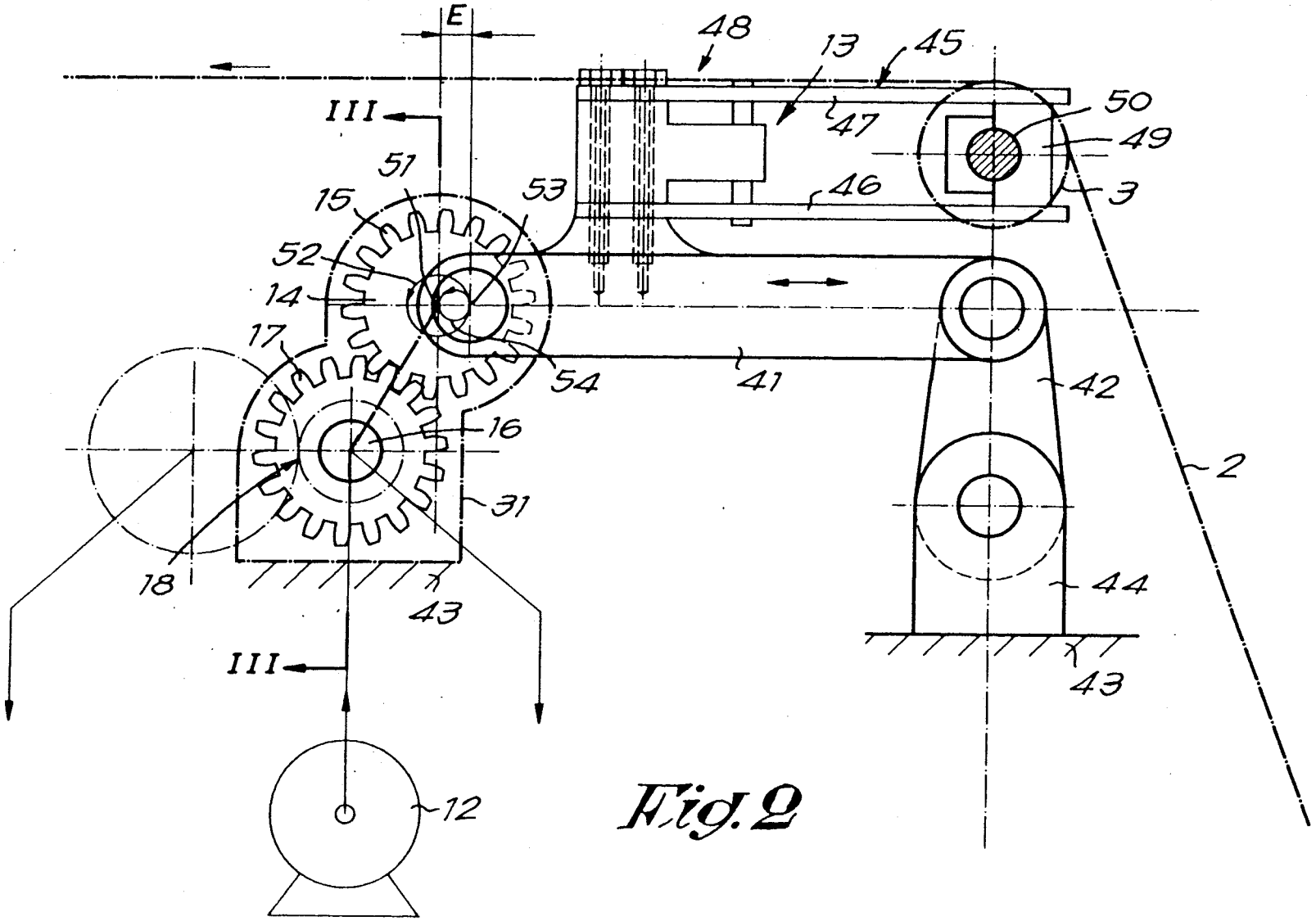
FIG. 2 shows a view of the part indicated in FIG. 1 as F2 to a greater scale.

As shown in FIG. 2, the back rest 3 is mounted on each end in a supporting mechanism 13 which is moved to and fro by means of a device 14. The movement of the back rest 3 is in this case periodical and synchronized with the movement of the harnesses 4. To this aim, the driving wheel 15 of said device 14, which consists, for example, of a gear, is coupled to the main shaft 16 of the weaving machine, for example by means of a gear 17 placed on it. The main shaft 16, for that matter, is coupled to the harness drive 5 in the known way via a transmission 18 with a transmission ratio of ½.

Figure 3:
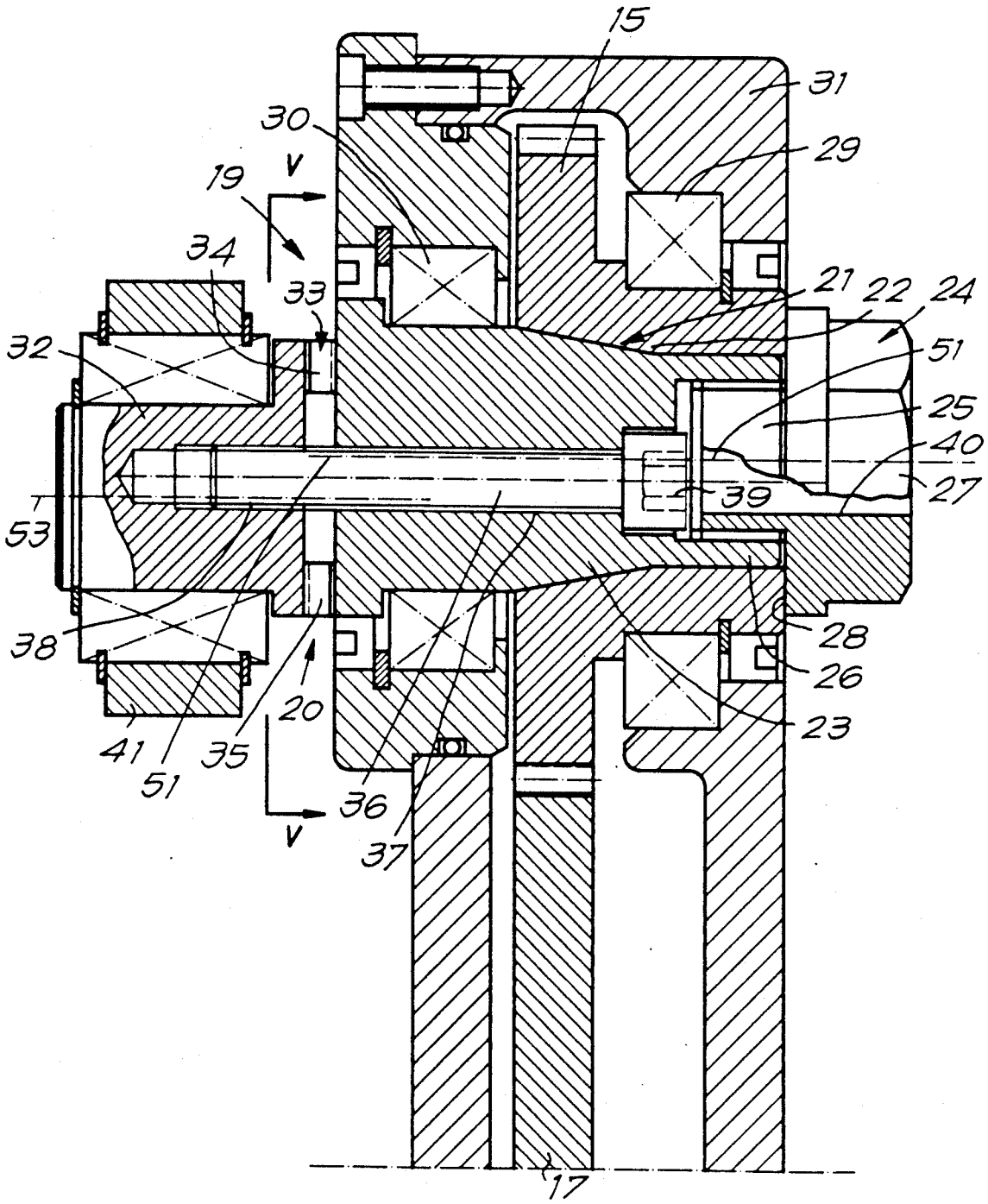
FIG. 3 is a cross-section according to line III—III in FIG. 2, but for a different position.

The present invention is special in that the device 14, as shown in FIG. 3, is made up of the combination of the above-mentioned supporting mechanisms 13 in between which the back rest 3 has been mounted; at least one eccentric 19 to move the supporting mechanisms 13 and which has been provided with setting means 20 to modify the eccentricity; the above-mentioned driving wheel 15, which drives the eccentric 19; and driving means to drive said driving wheel 15, which consists, in this case, of the gear 17, the main shaft 16 and the main drive motor 12; whereby means 21 are provided in between the driving wheel 15 and the eccentric 19 which allow for a continuous setting of the phase of the eccentric in relation to the driving wheel 15. These means 21 mainly consist in this case of a smooth seating 22, centrically formed in the driving wheel 15, an element 23 which fits in the seating 22 and which can be turned around in relation to the driving wheel 15 to which the eccentric 19 has been attached, and clamping means which can clamp the turnable element 23 in the seating 22 according to any required angle position.

In preference, the seating 22 is mounted directly in the driving wheel 15, and said seating 22 and the element 23 are conically shaped.

The clamping means preferably consist of a bolt-shaped element 24, which is made up of a threaded end 25 which can be axially screwed in the narrowest end 26 of the conical element 23, a screw head 27 and a collar 28 which can operate in conjunction with the driving wheel 15 or any other support whatsoever, in such a way that the conical element 23 can be clamped in the seating 22 according to the set angle position as a result of the screwing of screw head 27. It is clear that the collar 28 can also be formed by means of a washer.

It is clear that the driving wheel 15 and the element 23 have to be borne in an appropriate way, for example as indicated, by means of bearings 29 and 30 mounted in a housing 31.

The nature of the eccentric 19 and the setting means 20 is arbitrary. According to the embodiment described in FIG. 3, the eccentric is made up of a pivot 32 designed to make the eccentric movement, and a claw coupling 33 between the pivot 32 and the above-mentioned element 23, whereby said claw coupling 33 is made such that its first coupling element 34 is placed in an eccentric position and is attached onto or is part of the element 23, whereas the second coupling element 35 is attached eccentrically to the pivot 32. The pivot 32 is attached onto the element 23 by means of a bolt 36 which moves freely through a bore hole 37 into the element 23 and which is screwed into the pivot 32 with its threaded end 38. Both the bore hole 37 and the bolt 36 are placed in an eccentric position in relation to the element 23, but in a centric position with relation to the coupling part 34 of the claw coupling 33. The bolt 36 is placed in an eccentric position in relation to the pivot 32, but in a centric position in relation to the coupling element 35 of the claw coupling 33.

The head of the bolt 36 is countersunk under the bolt-shaped element 24. In order to be able to turn the bolt 36 without having to remove the bolt-shaped element 24, said bolt 36 has an internal hexagon 39 or something similar, while the bolt-shaped element 24 is provided with a bore hole 40 which makes the hexagon 39 accessible. The bolt 36 does not fit in this bore hole 40, however, and thus it cannot be taken out of the bore hole 37 without the bolt-shaped element 24 being removed.

The above-mentioned supporting mechanisms 13 which convert the eccentrical movement of the eccentric 19 in a periodical movement of the back rest 3 may, of course, be of an arbitrary form. In preference, use is to be made of a construction as represented in FIG. 2, in which these supporting mechanisms 13 mainly consist of an arm 41 which is borne with one end around the pivot 32 and which is coupled with hinges at its other end to a second arm 42, which, in turn, is attached at its opposite end in a rotatable way to a support 44 attached onto the frame 43 of the weaving machine.

The back rest 3 is preferably mounted on the arms 41 by means of elastic, bendable supports 45, each consisting of at least two parallel plate springs 46 and 47 which, at one end 48, are fixed onto the arm 41 and, at the other ends, are interconnected by means of an element 49 in which the shaft end 50 of the back rest 3 is mounted. The supports 45 may be arranged either horizontally as represented in FIG. 2 or in any other suitable direction.

It should be noted that the driving wheel 15 is driven at the same speed as the main shaft 16 of the weaving machine.

The working of the device 14 can be easily deduced from FIGS. 3 to 7.

In the position according to FIG. 3, as the driving wheel 15 rotates, the pivot 32 moves around the axis of rotation 51 of the element 23 and the driving wheel 15, in particular according to a movement 52 as indicated in FIG. 2, with an eccentricity E. The eccentricity E in this case equals the distance between said axis of rotation 51 and the axial axis 53 of the pivot 32.

Figure 4:
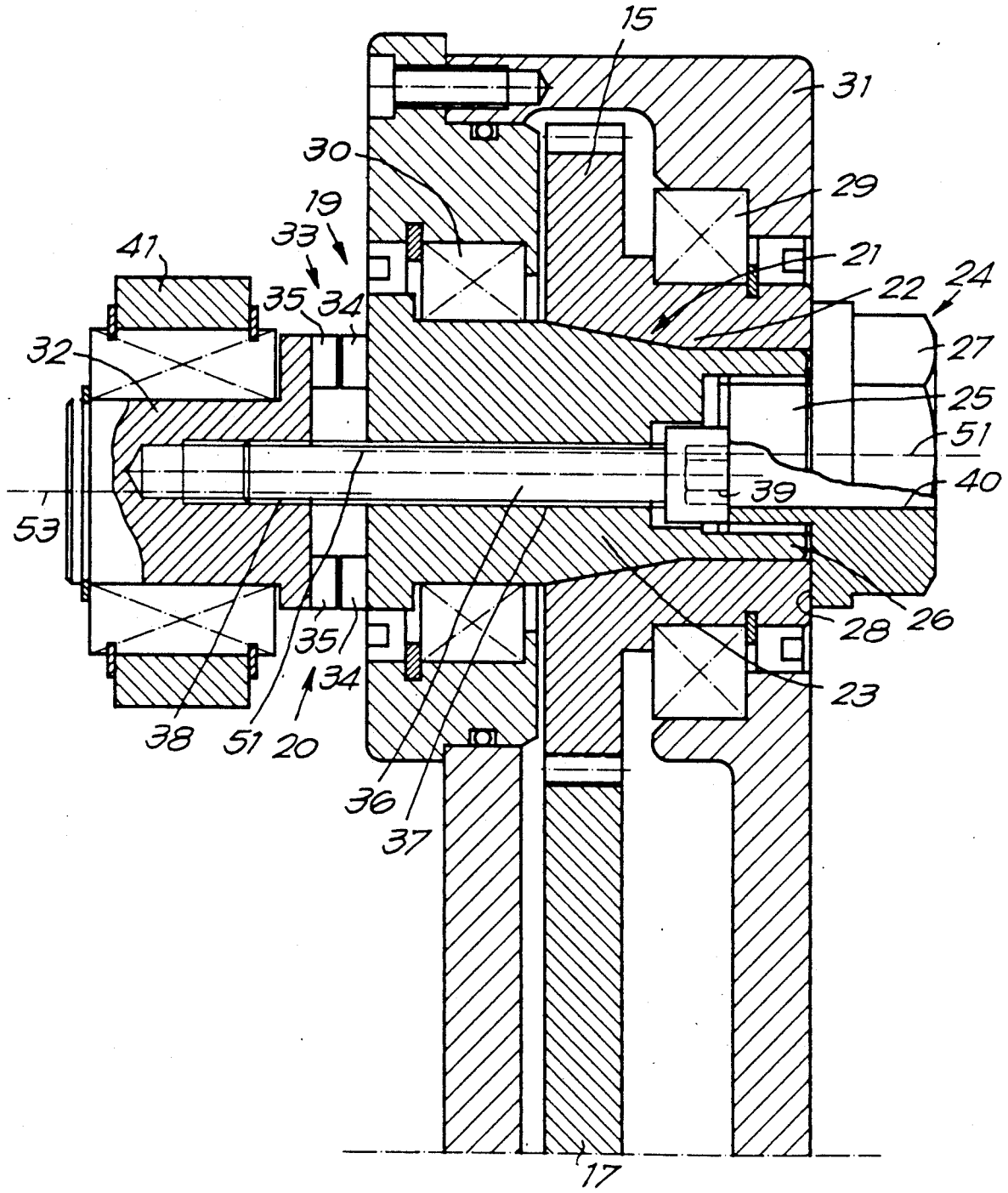
FIG. 4 shows a view similar to that in FIG. 3, but for another position.

When the eccentricity E is modified, the bolt 36 is unscrewed until a situation as represented in FIG. 4 is obtained, whereby the pivot 32 and the second coupling element 35 are pushed away from the first coupling element 34 as the head of the bolt 36 is prevented from making a notable axial movement due to the presence of the bolt-shaped element 24.

Figure 5:
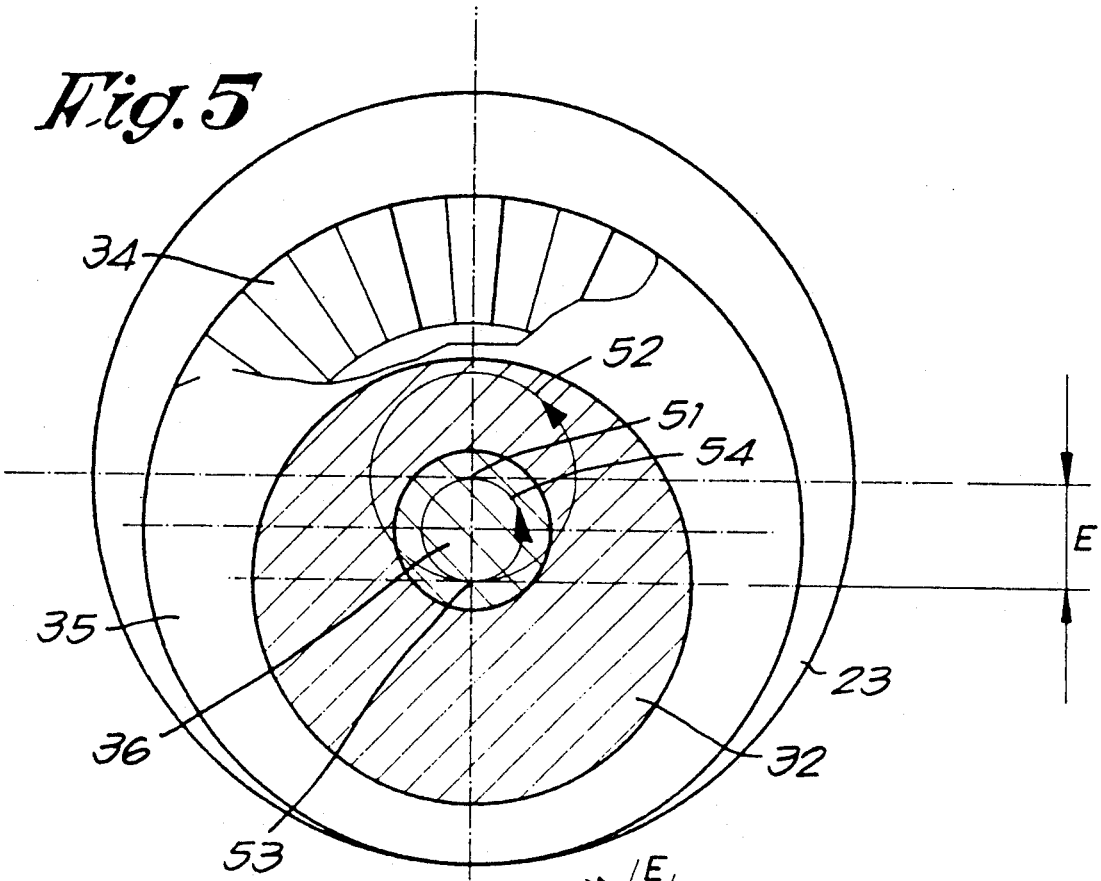
FIG. 5 shows a cross-section, to a greater scale, according to line V—V in FIG. 3.

The eccentricity E can then be modified by turning the second coupling element 35 of the claw coupling. As the coupling elements 34 and 35 are readjusted in relation to each other, the axis 53, however, makes a circular movement 54 as represented in FIG. 5, such that the eccentricity E can be set from zero to the maximum distance possible between the axis of rotation 51 and the axis 53. The claw coupling 33 is then closed again by screwing the bolt 36.

Figure 6:
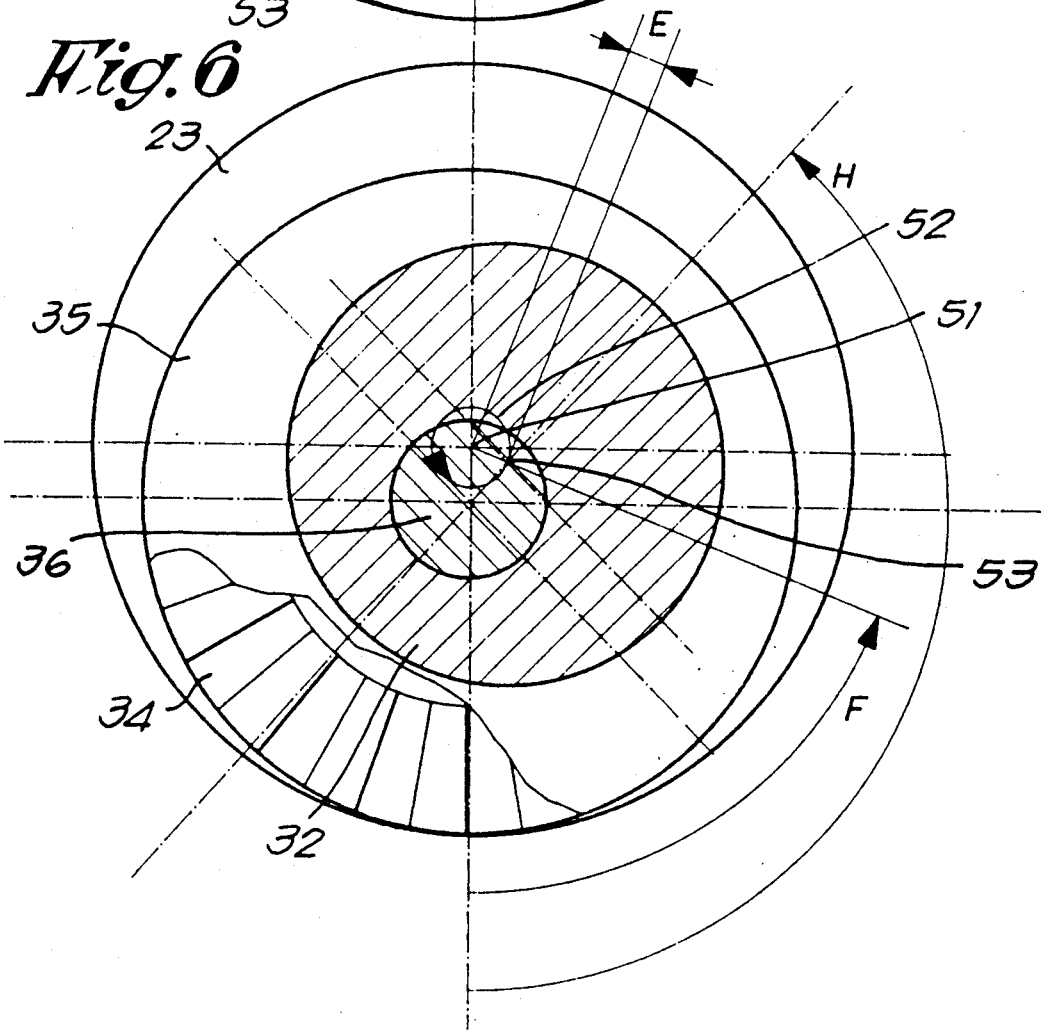
FIGS. 6 and 7 represent the part shown in FIG. 5 in various positions.

It is clear that the setting of a different eccentricity as described above also results in a phase shift F, as is shown in FIGS. 5 and 6, which represent a view before and after the modification of the eccentricity respectively, whereby H represents the rotation of the second coupling element 35 in relation to the first coupling element 34.

Figure 7:
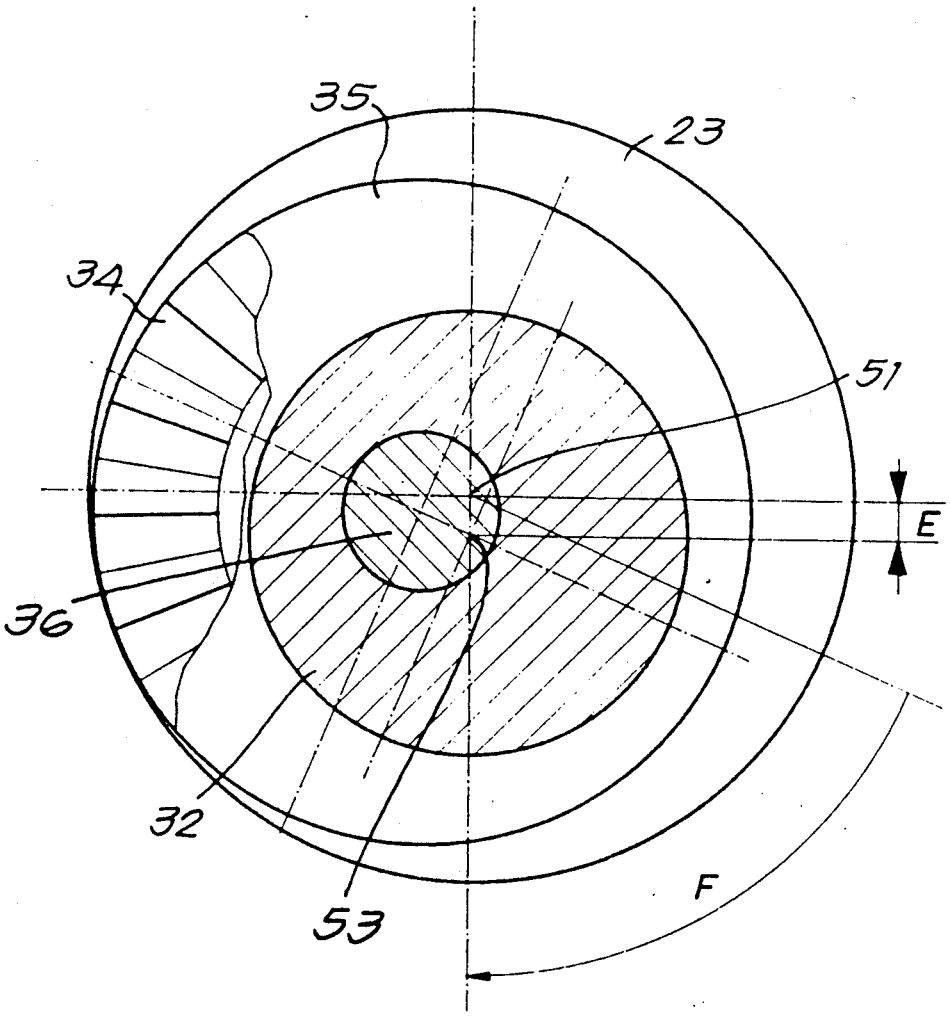

According to the present invention, the original phase can be easily reset by loosening the clamping means 24 and by turning the element 23 in the opposite sense in its seating 22, in particular until a situation as represented in FIG. 7 is obtained. The element 23 is then again clamped in the seating 22 by screwing the bolt-shaped element 24.

The device 14 according to the invention also makes it possible to cause a phase shift between the eccentric 19 and the driving wheel 15 in the case of a modification of the mutual movement of the harnesses in relation to the main shaft of the weaving machine. In this case, the clamping means 24 merely have to be loosened, the element 23 has to be turned in its seating 22, and the clamping means 24 have to be tightened again.

It is clear that the device 14 allows for a continuous setting in this case, as the element 23 can be secured to the driving wheel 15 according to an arbitrary angle position.

The device 14 according to the invention, for reasons other than those mentioned above, also allows for a phase shift according to any required value.

It is also clear that the device 14 can be used in combination with any sort of eccentric, whereby this eccentric does not necessarily have to be mounted directly onto the element 23, and whereby said eccentric does not necessarily have to have an adjustable eccentricity.

The present invention is in no way limited to the embodiments described by way of example and shown in the accompanying drawings; on the contrary, such a device for moving the back rest in weaving machines can be made in various forms and dimensions while still remaining within the scope of the invention.

We claim:

1. A device for periodically moving a back rest in a weaving machine, comprising:

means for supporting the back rest including two moveable supporting mechanisms between which the back rest is mounted; means including at least one eccentric member for moving the supporting mechanisms; drive means including a driving wheel for driving the eccentric member; driving means for driving the driving wheel; and continuous phase setting means between the driving wheel and the eccentric member for continuously setting the phase of the eccentric member in relation to the driving wheel, said continuous phase setting means comprising a seating connected to the driving wheel in a centric position relative to the driving wheel; a turnable element rotatably fitted in the seating and coupled to the eccentric member; and clamping means for clamping the turnable element in any required angular position in relation to said seating.

2. A device as claimed in claim 1, wherein said turnable element and said seating are conically shaped.

3. A device as claimed in claim 1, wherein the clamping means comprises means including a bolt-shaped element axially screwed in the turnable element for fastening the turnable element in said seating.

4. A device as claimed in claim 3, wherein the bolt-shaped element comprises a collar which rests on a side flank of the seating when the bolt-shaped element is axially screwed into the turnable element.

5. A device as claimed in claim 1, wherein the eccentric member comprises eccentricity setting means for modifying the eccentricity of the eccentric member.

6. A device as claimed in claim 1, wherein the eccentric member comprises a pivot and said supporting mechanisms are mounted on said pivot, and said eccentric member also comprises a claw coupling placed in between said pivot and said turnable element, said claw coupling comprising a first coupling element mounted eccentrically onto the turnable element and a second coupling element on which said pivot is mounted, said second coupling element and said pivot being mounted eccentrically in relation to each other.

7. A device as claimed in claim 6, comprising means including a bolt for tightening the claw coupling, said bolt passing through the turnable element and being situated parallel to an axis of rotation of the turnable element and centric in relation to said claw coupling.

8. A device as claimed in claim 7, wherein the clamping means comprise a bolt-shaped element, and wherein said bolt is countersunk under the bolt-shaped element, said bolt-shaped element comprising means including a bore hole for providing access to a head of said bolt such that the claw coupling can be loosened by turning the head, the bolt-shaped element preventing the bolt from axially shifting.

9. A device as claimed in claim 1, wherein the driving wheel comprises a gear coupled to a main shaft of the weaving machine and having the same speed of revolution as the main shaft.

10. A device as claimed in claim 9, wherein said seating is formed directly in said gear.

11. A device as claimed in claim 1, wherein each of the supporting mechanisms comprises an arm connected to the eccentric member at one end and rotatably coupled to a second arm at a second end, said second arm being rotatably mounted at an end thereof to a frame of the weaving machine.

12. A device as claimed in claim 11, further comprising means including elastic supports for mounting the back rest on said support mechanisms.

13. A device as claimed in claim 12, wherein each of said elastic supports comprises at least two parallel plate springs fixed at one end to said supporting mechanisms, and connected with each other at a second end to provide support for the back rest.

* * * * *